United States Patent [19]

Ferrero

[11] 4,263,641

[45] Apr. 21, 1981

[54] REFLECTOR FOR LIGHTING AND/OR INDICATOR DEVICES ESPECIALLY FOR VEHICLES

[75] Inventor: Giorgio Ferrero, Neive, Italy

[73] Assignee: Fiat Auto S.p.A., Turin, Italy

[21] Appl. No.: 958,468

[22] Filed: Nov. 7, 1978

[51] Int. Cl.[3] ..... F21V 5/02; F21V 13/02

[52] U.S. Cl. ..... 362/293; 362/309; 362/327; 362/340

[58] Field of Search ..... 362/296, 297, 304, 305, 362/307, 308, 309, 311, 326, 327, 333, 337, 339, 340, 347, 348, 349, 350, 230, 231, 293, 361

[56] References Cited

U.S. PATENT DOCUMENTS

| | | | |
|---|---|---|---|
| 1,570,503 | 1/1926 | Kralicek | 362/348 |
| 2,015,235 | 9/1935 | Rolph | 362/340 |
| 2,686,255 | 8/1954 | Pascucci | 362/361 |
| 3,527,974 | 9/1970 | Cooper | 362/293 |

FOREIGN PATENT DOCUMENTS

| | | | |
|---|---|---|---|
| 515651 | 12/1939 | United Kingdom | 362/340 |

*Primary Examiner*—Donald A. Griffin
*Assistant Examiner*—Alan Mathews
*Attorney, Agent, or Firm*—Sughrue, Rothwell, Mion, Zinn & Macpeak

[57] ABSTRACT

The reflector has a transparent body in the form of a paraboloid with a light source located within the reflector along the axis of symmetry. The inner surface of the reflector has a plurality of circular ridges of generally triangular cross-section, each ridge being defined by a cylindrical surface portion the axis of which is coincident with the axis of symmetry and by a frusto-conical surface portion adjacent to said cylindrical portion which lies on a cone having its axis coincident with said axis of symmetry with each of the cones having a common apex located approximately at the center of said light source.

3 Claims, 2 Drawing Figures

REFLECTOR FOR LIGHTING AND/OR INDICATOR DEVICES ESPECIALLY FOR VEHICLES

The present invention relates to a reflector, and particularly to a reflector suitable for the headlamps, side lights and/or the indicator lights of a motor vehicle.

In the present state of the art, reflectors are made of non-transparent materials, such as metal, for example steel or anodised aluminum, which are varnished or plated, for example chronium plated, to provide a smooth reflective surface. The processes involved in their manufacture are very involved, however, and such reflectors are therefore very costly. Moreover, such reflectors have disadvantages in that with the passage of time they may be attacked by corrosive agents, and after a few years may have deteriorated to such an extent that they are no longer able properly to fulfill their function.

The present invention seeks, therefore, to provide a reflector in which the aforementioned disadvantages are overcome, the reflector being made of a transparent material, such as, for example, glass or plastics material which does not require further treatment once formed and which is not significantly attacked by corrosive atmospheric agents. Reflectors made as embodiments of the present invention can be of lower cost than conventional reflectors in that they require no operations other than moulding. Moreover, the fixing to the body of such reflectors can be made much simpler than the fixing of conventional metal reflectors since plastics material especially is more versatile than metal, it being possible to provide it with ribbing and/or bosses to facilitate mounting.

According to the present invention a reflector for a lamp such as a motor vehicle lamp, is characterised in that it comprises a body of transparent material on at least one surface of which there are provided a plurality of circular ridges or grooves of generally triangular cross section defined by two sets of surfaces inclined with respect to one another.

Embodiments of the present invention, being made of transparent material through which light passes upon reflection, can also serve at the same time as a colour filter to change the colour of the light emitted by a lamp bulb situated within the lamp of which the reflector forms part.

Another advantage of the present invention is that, if embodiments are made of plastics material, which is an insulator, the reflector itself can serve as a support for contacts or lampholders, or alternatively the body itself of the lamp of which the reflector forms part can be made of the same transparent material as the reflector.

Various embodiments of the present invention will now be more particularly described, by way of example, with reference to the accompanying drawings, in which.

Figure 1:
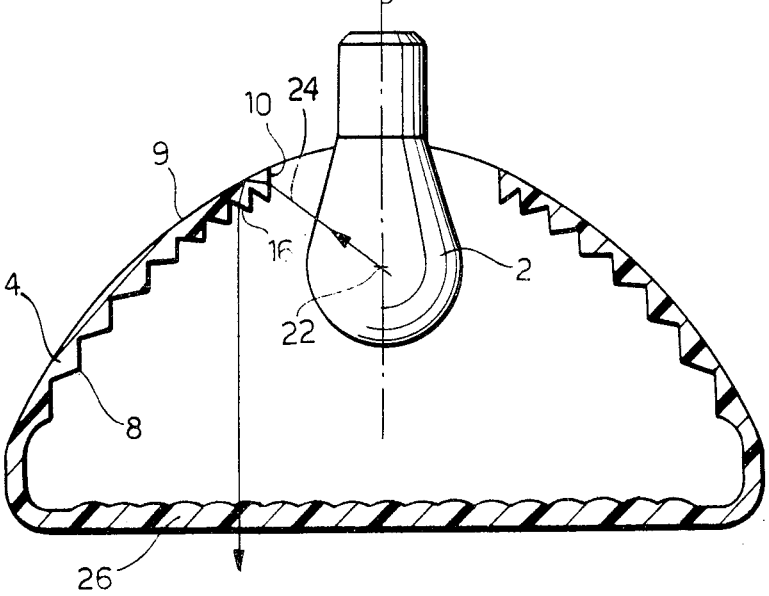
FIG. 1 is a diagrammatic sectional view of a reflector formed as a first embodiment of the invention adapted for use as a motor vehicle headlamp.
Figure 2:
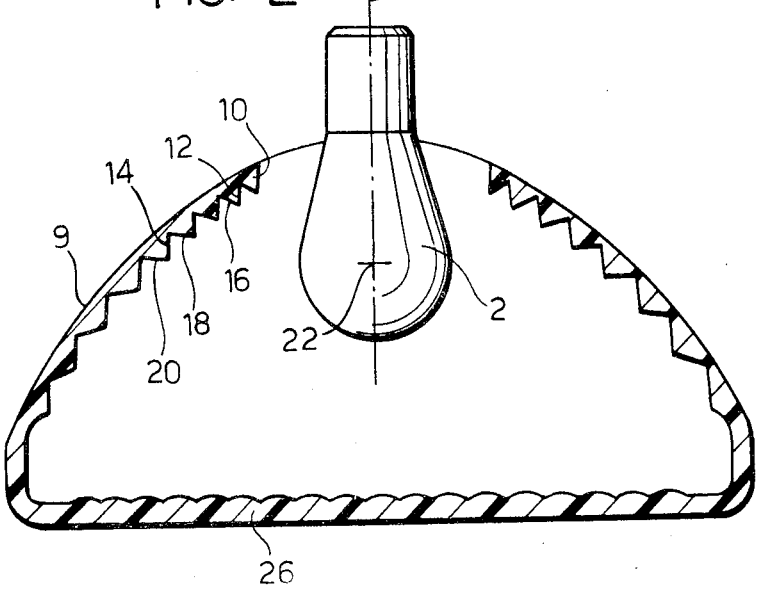
FIG. 2 is a detail view of certain elements of FIG. 1.

Referring now to FIGS. 1 and 2 of the drawings there is shown a bulb 2 for producing light and a reflector 4 formed as an embodiment of the invention, this reflector being generally paraboloid in form.

The optical axis of the lamp 2 and the reflector 4 is indicated by a line 6 passing through the centre of the bulb 2.

The inner surface 8 of the reflector 4 is formed with a plurality of concentric circular ridges of triangular cross section for the purpose of producing a reflection effect similar to that previously produced by metalisation of the inner surface of the paraboloid body in reflectors of known type.

Each circular ridge of triangular cross section is defined by two surfaces some of which are indicated in FIG. 2 by the reference numerals 10, 12 and 14, indicating surfaces facing radially inwardly towards the bulb 2, and 16, 18, 20 indicating surfaces facing generally away from the bulb 2.

The surfaces 10, 12, 14 of the ridges, which face towards the bulb 2 each form part of a family of generally cylindrical surfaces, the common axis of which is coincident with the optical axis 6 of the lamp and reflector. The other surfaces 16, 18, 20 of the ridges, which face generally away from the bulb are each part of respective conical surfaces each of which has its apex in proximity to the filament of the bulb and its axis substantially coincident with the optical axis of the lamp and reflector.

Across the wide end of the paraboloid reflector 4 is a transparent element 26 through which passes light from the bulb and reflector in use of the lamp.

The reflector described above works as follows:

Considering in detail a single ray of light 24 emitted from the light bulb 2 and assuming that the source is concentrated at a single point 22. The ray 24 is incident on the cylindrical radially inwardly facing surface 10 of the innermost of the concentric circular ridges of triangular cross section, is refracted as it passes this surface and enters into the transparent material which constitutes the paraboloid reflector.

The position of the bulb must be such that the angle of incidence on the surface 10 is such that the ray of light 24, having been refracted into the reflector, reaches the outer surface 9 of the reflector at an angle of incidence greater than the value of the critical angle, so that the ray undergoes internal reflection at this outer surface 9 and is directed back through the thickness of the reflector towards the other surface 16 of the triangular section ridge on which it was incident. When the light ray 24 arrives at the surface 16 its angle of incidence thereto is less than the critical angle, and it is therefore refracted as it passes the surface 16 travelling towards the interior of the headlamp itself. All rays of light incident on the surface 10 will follow a similar path except for those very close to the surface 16 before reflection at the surface 9 and these will pass out through the surface 18 of the adjacent ridge and therefore will not be exactly parallel to the optical axis 6: however, this will affect only a small proportion of the light and the inclination from the required path will be very slight, light rays incident on the other cylindrical surfaces of the reflector will follow similar paths, undergoing total internal reflection at the surface 9 and being refracted onto a path parallel to, or at least substantially parallel to the optical axis of the paraboloid reflector body.

In order that the behaviour of the light rays shall be regular it is necessary that in their passage from the bulb to the outer surface 9 of the reflector they shall not encounter the radially outer surfaces 16, 18 and 20 of the triangular cross section ridge and it is for this reason that these surfaces have to be substantially conical since the plane of these surfaces at any point is then substantially parallel to the direction of the light rays. If there is any variation from this it must be such that the surface is inclined in relation to the light ray in such a way that its projection intersects the optical axis 6 on the side of the light source nearer to the apex of the paraboloid.

Moreover, it will be appreciated that the rays reflected from the outer surface 9 of the reflector must not again encounter the radially inner surfaces 10, 12 and 14 and it is for this reason that these have to be formed as substantially cylindrical surface elements with their axes substantially parallel to the optical axis 6.

The light rays emitted by the lamp illustrated in FIGS. 1 and 2 thus emerge all substantially parallel to the optical axis through the transparent element 26. By making the reflector 4 of a suitably coloured material it can serve also both as a reflector and as a light colour changer. This is particularly beneficial in circumstances where changing the colour of the light cannot be effected by colouring the outer transparent element 26 of the lamp, for aesthetic or for type approval reasons. Thus, for example, if the reflector 4 is of a light blue colour, the transparent element 26 is colourless and the lamp bulb 2 tends to a yellow colour, the integration of all these elements leads to the production of a light emerging from the transparent element 26 having a perfectly white colour, with a continuous, linear spectrum over a wide wavelength band.

What we claim is:

1. A reflector for a lamp comprising a body of transparent material, substantially in form of a paraboloid, having an inner surface and an outer surface, said body of transparent material being provided on its inner surface with a plurality of circular ridges of generally triangular cross section, each ridge being defined by a cylindrical surface portion, which lies on a cylinder having its axis coincident with the axis of symmetry of said body, and by a frusto-conical surface portion, adjacent to said cylindrical surface portion, which lies on a cone having its axis coincident with said axis of symmetry, all the cones defining the frusto-conical surface portions of said body having a common apex located on said axis of symmetry in such a position that, when a light source is placed in proximity of this position, light rays coming from the light source are refracted by said cylindrical surface portions, then reflected by the outer surface of said body and finally refracted by said frusto-conical surface portions in a direction parallel to said axis of symmetry.

2. A reflector as set forth in claim 1, wherein the transparent material constituting the reflector body is coloured for modifying the spectrum of incident light upon reflection thereby.

3. A motor vehicle lamp, comprising a light source and a reflector constituted by a body of transparent material, substantially in form of a paraboloid, having an inner surface and an outer surface, said body of transparent material being provided on its inner surface with a plurality of circular ridges of generally triangular cross section, each ridge being defined by a cylindrical surface portion, which lies on a cylinder having its axis coincident with the axis of symmetry of said body, and by a frusto-conical surface portion, adjacent to said cylindrical surface portion, which lies on a cone having its axis coincident with said axis of symmetry, all the cones defining the frusto-conical surface portions of said body having a common apex located on said axis of symmetry in proximity of the light source, the position of said common apex along said axis of symmetry being such as to permit light rays coming from the light source to be refracted by said cylindrical surface portions, then reflected by the outer surface of said body and finally refracted by said frusto-conical surface portions in a direction parallel to said axis of symmetry.

* * * * *